US006398067B1

(12) United States Patent
Belfance et al.

(10) Patent No.: US 6,398,067 B1
(45) Date of Patent: Jun. 4, 2002

(54) TAMPER-PROOF CONTAINER CAP ASSEMBLY AND RELATED METHODS

(75) Inventors: John Belfance, Fonda, NY (US); Ronald Supranowicz, Lennox, MA (US)

(73) Assignee: CV Holdings, LLC, Amsterdam, NY (US)

( * ) Notice: Subject to any disclaimer, the term of this patent is extended or adjusted under 35 U.S.C. 154(b) by 0 days.

(21) Appl. No.: 09/710,330

(22) Filed: Nov. 9, 2000

Related U.S. Application Data

(60) Provisional application No. 60/164,807, filed on Nov. 10, 1999.

(51) Int. Cl.[7] ..... B65D 43/14

(52) U.S. Cl. ..... 220/833; 215/235; 215/237; 215/253; 215/250; 215/901; 220/836; 220/839

(58) Field of Search ..... 215/235, 237, 215/250, 253, 316, 901, 321, 45, 244, 245; 220/266, 324, 833, 836–839; 206/507; 292/80, 87

(56) References Cited

U.S. PATENT DOCUMENTS

| | | | | |
|---|---|---|---|---|
| 3,860,148 A | * | 1/1975 | Sherin | 220/266 X |
| 4,351,630 A | | 9/1982 | Hayberg et al. | |
| 4,783,056 A | | 11/1988 | Abrams | |
| 4,807,425 A | | 2/1989 | Abrams | |
| 4,809,874 A | * | 3/1989 | Pehr | 215/235 |
| 4,812,116 A | | 3/1989 | Abrams | |
| 4,955,513 A | | 9/1990 | Bennett | |
| 4,974,735 A | * | 12/1990 | Newell et al. | 215/253 |
| 5,012,941 A | | 5/1991 | Abrams et al. | |
| 5,108,029 A | | 4/1992 | Abrams et al. | |
| 5,133,470 A | | 7/1992 | Abrams et al. | |
| 5,169,374 A | | 12/1992 | Abrams et al. | |
| 5,199,635 A | | 4/1993 | Abrams et al. | |
| 5,219,320 A | | 6/1993 | Abrams et al. | |
| 5,270,011 A | * | 12/1993 | Altherr | 215/237 X |
| 5,429,699 A | | 7/1995 | Abrams et al. | |
| 5,474,177 A | | 12/1995 | Abrams et al. | |
| 5,624,528 A | | 4/1997 | Abrams et al. | |
| 5,685,444 A | * | 11/1997 | Valley | 215/253 |
| 5,723,085 A | | 3/1998 | Abrams et al. | |

* cited by examiner

*Primary Examiner*—Lee Young
*Assistant Examiner*—Robin A. Hylton
(74) *Attorney, Agent, or Firm*—Dreier & Baritz LLP

(57) ABSTRACT

A tamper-proof container and cap assembly is provided, comprising a container having an upper portion and an outer surface. The container has a rim at the upper portion. The upper portion includes a flexible and detachable protrusion having a contact element and a break point. The container also has a cap having a base with an outer periphery and a skirt extending perpendicularly and outwardly around the outer periphery of the base. The cap has a hinge and a tap with a first and second slot wherein the first slot is capable of housing the protrusion, and the second slot has an interlocking device that mates with the protrusion. In an empty stage, the protrusion is positioned within the first slot. In a filled stage, the cap is placed upon the container and the protrusion is repositioned within the second slot and the contact element engages the interlocking device to form a tamper-proof seal.

15 Claims, 3 Drawing Sheets

TAMPER-PROOF CONTAINER CAP ASSEMBLY AND RELATED METHODS

RELATED APPLICATION

This application is claiming benefit to the prior filed provisional application U.S. Ser. No. 60/164,807 filed, Nov. 10, 1999.

FIELD OF THE INVENTION

The present invention relates to a tamper-proof container and cap assembly and related methods by tamper-proofing a container and cap assembly.

BACKGROUND OF THE INVENTION

It is desirable to provide a container and cap assembly that can produce a tamper-proof seal. For example, during forensic and laboratory applications such as drug and alcohol testing, uses of such containers desire a tamper-proof seal to establish the integrity of the specimens. Consequently the so-called "chain of custody" of the contents of the container is visually maintained.

SUMMARY OF THE INVENTION

The present invention relates to a tamper-proof container and cap assembly comprising a container and a cap. The purpose of the present invention is to produce a container that allows a user to fill the container with the desired material (e.g. blood, urine). Subsequently, the user closes the cap of the container and engages a tamper-proof indicator.

In one embodiment, the container has an upper portion and an outer surface. The container has a rim at the upper portion. The upper portion of the container includes a flexible and detachable protrusion having a contact element and a break point. In another embodiment, the cap has a base with an outer periphery and a skirt extending perpendicularly and outwardly around the outer periphery of the base. The cap also has a hinge and a tab extending perpendicularly and outwardly from the skirt of the cap. In still another embodiment, the top has a least two slots capable of housing the protrusion. In yet another embodiment, the cap has a first slot and a second slot including an interlocking device for engaging with the protrusion.

In a further embodiment, when the container is in an empty stage, the protrusion is positioned within the first slot. In still a further embodiment, when the container is in a filled stage, the cap is placed upon the container and the protrusion is repositioned within the second slot causing the contact element of the protrusion to engage the interlocking device of the second slot and thus to form a tamper-proof seal. For purposes of this invention, the term "empty stage" refers to a stage when the container is empty prior to filling. For example, when the container is shipped to a laboratory from the manufacturer of the container. The term "filling stage" refers to a stage after the container has been filled with its content. In one embodiment, the contents may include specimens such as blood samples, urine samples or other bodily fluids of a patient. In yet another embodiment, the protrusion is formed in such a way that, if the cap is opened (i e. tampered with), the protrusion will break off and thus, evidence of tampering with the container will be evident by the broken protrusion. It will be appreciated that it may not be possible to replace the protrusion once it has broken, since the protrusion is formed integrally with the container. Therefore, it should not be possible to defeat the tamper-proof capabilities by replacing the original broken protrusion. It will also be appreciated that the interlocked protrusion not only provides a tamper-proof function, but also may aid in preventing dislodgement of the cap during transport.

For purposes of the present invention, the phrase "tamper-proof seal" means a visual indication that: (a) when not broken, the container's cap has not been opened; and (b) when broken, the container cap has been opened and thus, visually displays that the container was tampered with.

In another embodiment, the present invention relates to a method of tamper-proofing a container and a cap assembly by: (a) providing a container have an upper portion and an outer surface, the upper portion having a flexible and a detachable protrusion having a contact element and a break point; and a cap having a base with an outer periphery and a skirt extending perpendicularly and outwardly around the outer periphery of the base, the cap has a hinge and a tab extending perpendicularly and outwardly from the skirt of the cap, the tab comprising a first and second slot capable of housing the protrusion, the second slot having an interlocking device; (b) positioning the protrusion within the first slot in an empty stage; (c) opening the cap and filling the container; and (d) closing the cap upon the container and repositioning the protrusion within the second slot thereby allowing the contact element of the protrusion to engage the interlocking device to from a tamper-proof seal.

In yet another embodiment, the method further comprises applying a sufficient frontal, upward force upon the tab to allow the interlocking device of the slot to engage the contact element of the protrusion and thus to detach the protrusion from the flange at the break point to thereby breach the seal.

BRIEF DESCRIPTION OF DRAWINGS

A more complete appreciation of the present invention and many of the attendant advantages thereof will be readily understood by reference to the following description was considered in connection with the accompanying drawings in which.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various embodiments and features thereof.

DETAILED DESCRIPTION OF THE PRESENT INVENTION

Figure 1:
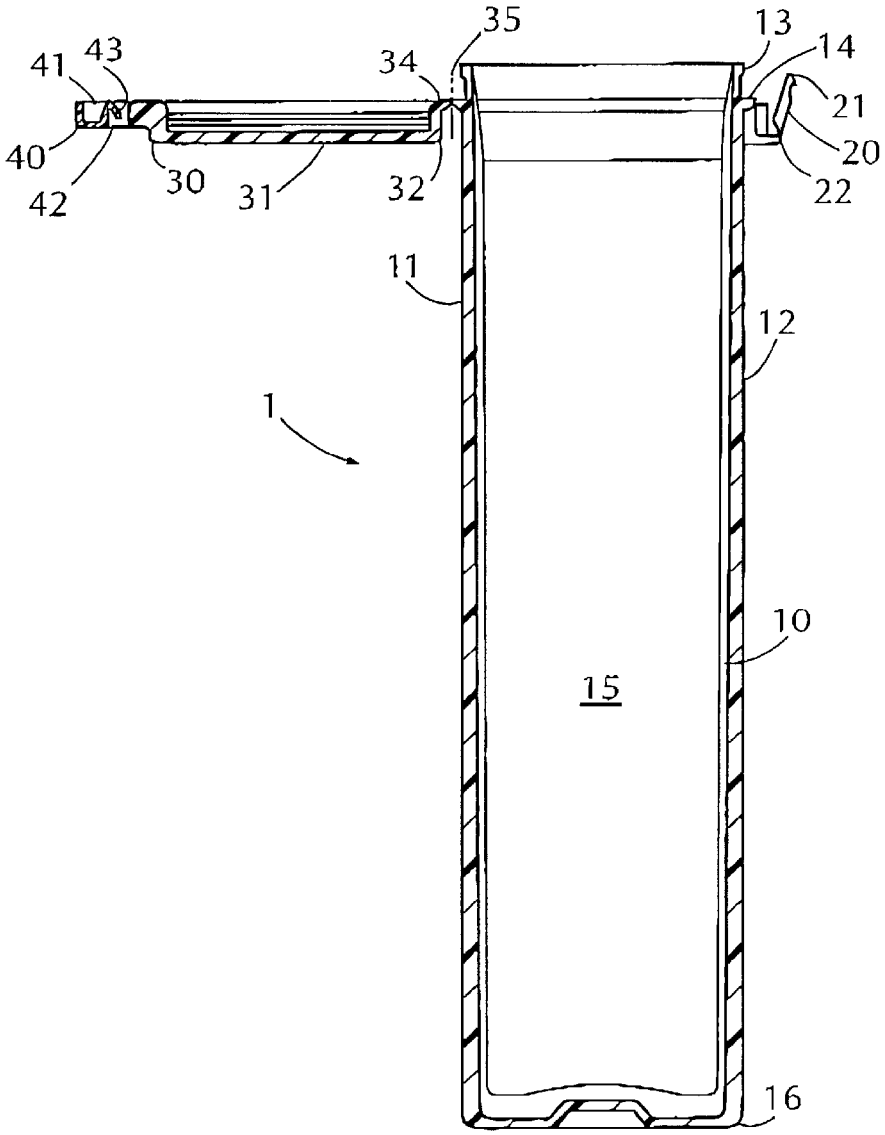
FIG. 1 is a longitudinal sectional view of one embodiment of the tamper-proof container and cap assembly of the present invention.

Referring now to the drawings wherein like references designate identical or corresponding parts throughout the several views, and more particularly to FIG. 1 wherein one embodiment of the tamper-proof container and cap assembly 1 of the present invention is illustrated. The assembly 1 comprises a container 10 having a base 16, or internal cavity 15, and outer surface 12 and an upper portion 11. The container 10 has a rim 13 at the upper portion 11. The container 10 also has a flange 14 extending radially outwardly from the outer surface 12 of the container 10. A detachable protrusion 20 with a contact element 21 and a break point 22 is located at or near flange 14. The assembly 1 also includes a cap 30 having a base 31. The cap 30 also has a tab 40 and a hinge 34. The tab 40 has a first and second slot 41 and 42 respectively, capable of housing the protrusion 20. The second slot 42 comprises an interlocking device 43.

The hinge 34 is also attached at or near the container flange 14. In one embodiment, the hinge 34 has a recess 35 that function as a binding point for ease of opening and closing of the container 10.

Suitable material for assembly 10 includes plastic (e.g. thermoplastic, such as polypropylene and polyethylene). In an embodiment, the cap 30 and the container 10 may be integrally molded of the plastic to form a hinge 34 there between. In another embodiment, the cap 30 and the container 10 may be produced in a molding process and, in still another embodiment, may be molded in accordance with the mold similar to that disclosed in U.S. Pat. Nos. 4,783,056 and 4,812,116 respectively. In a further embodiment, with such a process and mold, the assembly, including the cap, container and hinge may be produced in accordance with the operation disclosed in U.S. Pat. Nos. 4,783,056 and 4,812,116 or, in another embodiment, may be produced in accordance with U.S. Pat No. 5,723,085. The disclosure of these patents are incorporated by reference herein.

Figure 2:
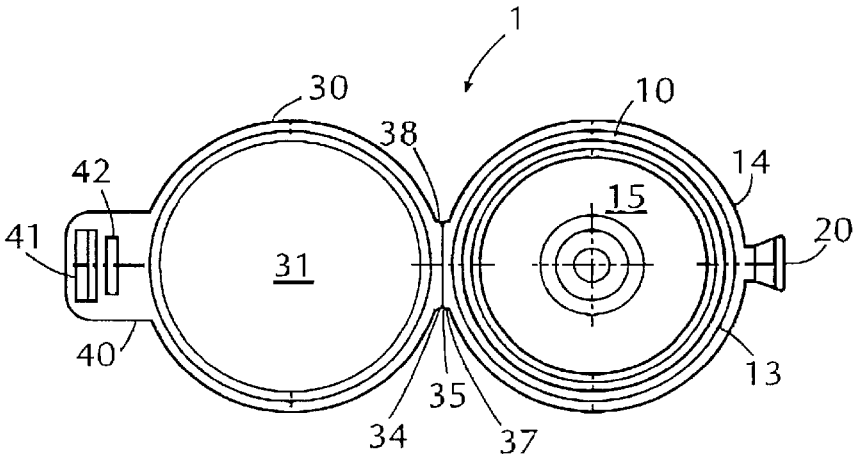
FIG. 2 is an overhead plan view of one embodiment of the container and cap assembly in an opened position.

FIG. 2 refers to an overhead plan view of the assembly 10 of the present invention in an opened position. The assembly 10 includes the container 10 and the cap 30 connected by the hinge 34. The container 10 has the cavity 15, the rim 13 and the flange 14. The cap 30 includes the circular base 31 and the tab 40. The tab 40 includes a first slot 41 and second slot 42. The hinge 34 has a recess 35 and two elements, 37 and 38 respectively. The first element 37 is attached to the flange 14 of the container 10 and second element 38 is attached to the cap 30.

Figure 3:
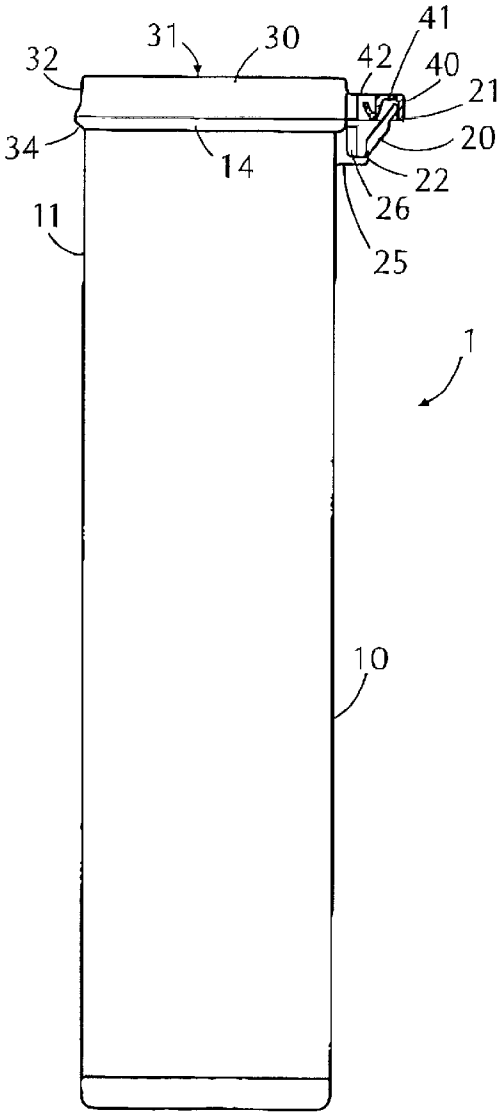
FIG. 3 is a side elevation view of one embodiment of the present invention of the container and cap assembly in an empty stage.
Figure 5:
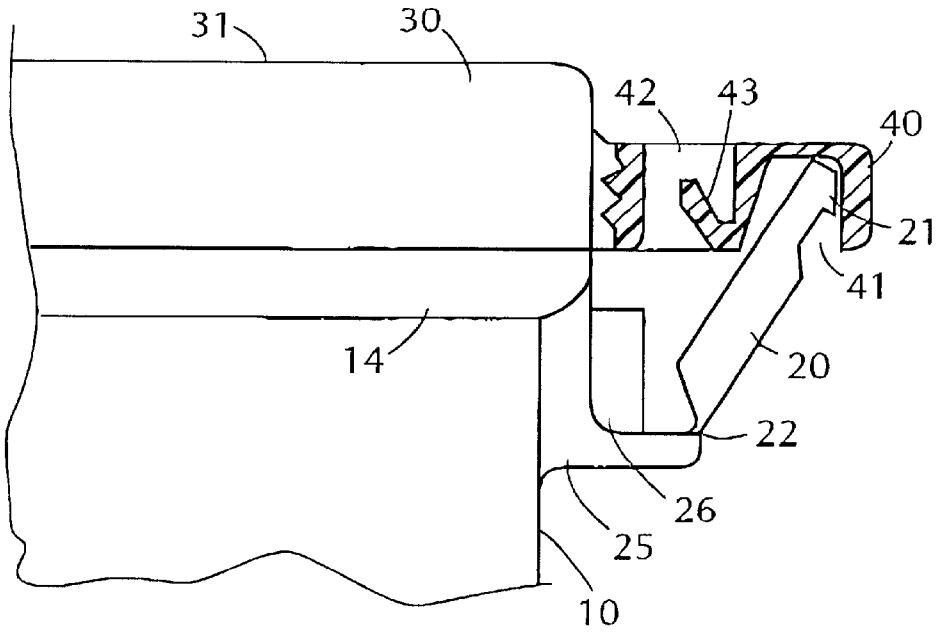
FIG. 5 is a blow-up of one embodiment of the present invention of the protrusion of the flange of the container in the empty stage.

FIG. 3 and FIG. 5 depict one embodiment of the present invention of the container and cap assembly 1 the empty stage prior to filling. The container 10 has a flange 14 which includes protrusion 20. The protrusion 20 has a u-shaped element 25. The protrusion 20 has a contact element 21 and a break point 22. In the empty stage, the contact element 21 of the protrusion 20 is situated in the first slot 41 of the top 40 of the cap 30. It is understood that other designs of first slot 41 are contemplated. The only design requirement of first slot 41 is that it serves the purpose of holding protrusion 20 in place during handling and prior to the filling stage. As such, protrusion 20 is protected from accidentally being torn off prior to engaging protrusion 20 with interlocking device 43. There is a space between the protrusion 20 and the stop rib 26 and the second slot 42 with the interlocking device 43 remaining empty.

Figure 4:
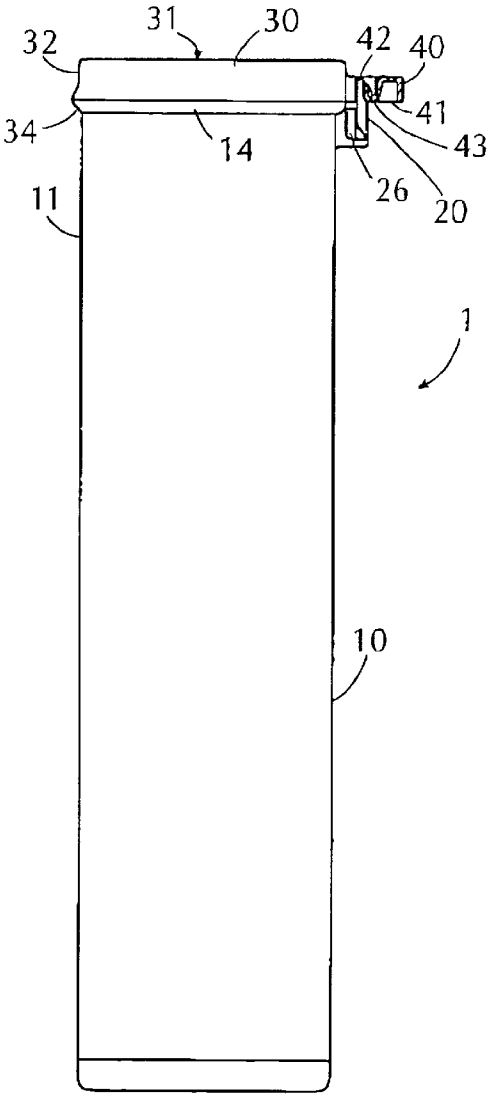
FIG. 4 is a side elevation view of one embodiment of the present invention of the container and cap assembly in a filled stage.
Figure 6:
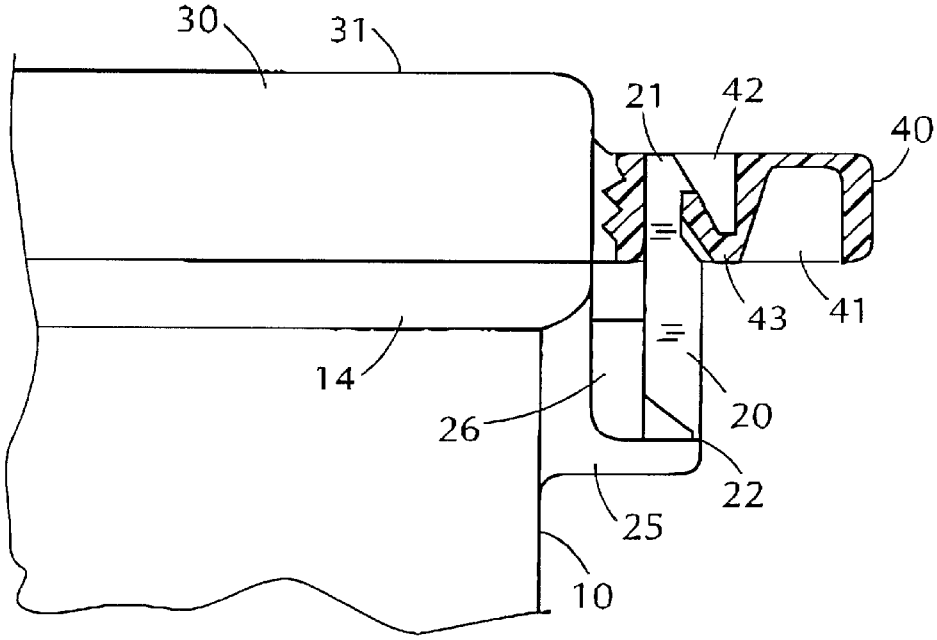
FIG. 6 is a blow-up of one embodiment of the present invention of the protrusion of the flange of the container in the filled stage.

FIG. 4 and FIG. 6 illustrates the container and cap assembly 1 of the present invention in the filled stage. The cap 30 is placed upon the container 10 and the protrusion 20 is repositioned with the second slot 42. The contact element 21 of the protrusion 20 engages the interlocking device 43 of the second slot 42 of the tab 40 to form a tamper-proof seal. The stop rib 26 restricts the movement of the protrusion 20.

Subsequently, a user would break the tamper-proof seal by applying sufficient frontal upward force to allow the interlocking device 43 of the second slot 42 to engage the contact element 21 of the second slot 42 and to engage the contact element 21 of the protrusion 20 to detach the protrusion 20 from the flange 14 at the break point 22.

It is understood that the design of break point 22 is such that, when sufficient frontal upward force is applied to the cap to open the vial, the protrusion must fail (e.g. break) at break point 22 prior to any failure between the engagement of protrusion 20 with interlocking device 43. Consequently, in one embodiment, break point 22 width is sufficiently narrow to break when sufficient frontal upward force is applied to open the vial while, at the same time, is sufficiently flexible and of suitable design to allow for: (a) protrusion 20 to be moved from the first slot to the second slot without breakage; and (b) protrusion 20 to remain engaged with interlocking device 43 while sufficient force is applied to open the vial and break at break point 22.

Interlocking device 43 may be any design that is able to directly mate with protrusion 20 and remain engaged even when sufficient frontal force is applied to cause a break at break point 22. Such interlocking devices may include teeth, flexible projections and suitable wedge-like shapes.

Numerous modification and variations of the present invention are possible in light of the above discussion.

It will be appreciated that many modifications and other variations that will be appreciated by those skilled in the art within the intended scope of this invention without departing from the teachings, spirit and intended scope of the invention.

What is claimed is:

1. A tamper-proofed container and cap assembly comprising:

a container having an upper portion and an outer surface, said container having a rim at said upper portion, a detachable protrusion, which is located at the upper portion, having a contact element and a break point;

a cap having a base with an outer periphery and a skirt extending perpendicularly and outwardly around said outer periphery of said base; said cap having a hinge and tab extending perpendicularly and outwardly from said skirt of said cap; said tab comprises at least a first and second slot capable of housing said protrusion; said second slot comprising an interlocking device; and in an empty stage, said protrusion is positioned within said first slot; and in a filled stage, said cap is placed upon said container and said protrusion is repositioned within said second slot and said contact element of said protrusion engages said interlocking device to form a tamper-proof seal.

2. The assembly of claim 1 wherein said protrusion has upper and lower ends, said contact element being positioned at said upper end and said point being positioned at said lower end.

3. The assembly of claim 1 wherein said cap has a circular base and a cylindrical tubular skirt.

4. The assembly of claim 1 wherein said tab and said hinge are position at opposing ends of said cap.

5. The assembly of claim 1 wherein a frontal, upward force causes said protrusion to detach from said break point to thereby break said seal.

6. The assembly of claim 1 wherein said hinge is attached to said container flange.

7. The assembly of claim 1 wherein said skirt of said cap overlies said container and said rim of said container when said container is closed after said filling stage.

8. The assembly of claim 7 wherein said skirt of said cap is designed to overlie and sit upon said container flange when said container is closed after said filling stage.

9. The assembly of claim 1 wherein said flange comprises a stop rib situated adjacent to said protrusion.

10. The assembly of claim 1 wherein said cap and said container are molded of plastic.

11. The assembly of claim 10 wherein said cap and said container are integrally molded of said plastic to form a hinge there between.

12. The assembly of claim 1 wherein said cap is pre-fit to said rim of said container during said closed position.

13. The assembly of claim 1 wherein said hinge has a recess, said recess forms two elements, one element being attached to said skirt of said cap and said second element being attached to said container; said recess functions as a bending point during the opening and closing of said container.

14. The assembly of claim 1 wherein said protrusion comprises a u-shaped element having two legs, one of said legs being attached to said flange and said other leg being a detachable leg having said contact element.

15. A method of tamper-proofing a container and cap assembly, comprising:

(a) providing a container having an upper portion and an outer surface, said upper portion having a detachable protrusion having a contact element and a break point; a cap having a base with an outer periphery and a skirt extending perpendicularly and outwardly around said outer periphery of said base; and cap having a hinge and tab extending perpendicularly and outwardly from said skirt of said cap; said tab comprises at least a first and second slot capable of housing said protrusion; said second slot comprising an interlocking device; and (b) positioning said protrusion with said first slot in an empty stage;

(c) opening said cap and filling said container;

(d) closing said cap upon said container and repositioning said protrusion within said second slot thereby allowing said protrusion to engage said interlocking device to form a tamper-proof seal.

* * * * *